US006531983B1

(12) United States Patent
Hirose et al.

(10) Patent No.: US 6,531,983 B1
(45) Date of Patent: Mar. 11, 2003

(54) METHOD FOR ANTENNA ASSEMBLY AND AN ANTENNA ASSEMBLY WITH A CONDUCTIVE FILM FORMED ON CONVEX PORTIONS

(75) Inventors: Eiichiro Hirose, Saitam-ken (JP); Akikazu Toyoda, Saitam-ken (JP); Hiroaki Tanidokoro, Saitama-ken (JP); Shinji Sakai, Saitama-ken (JP); Yoshiomi Go, Saitama-ken (JP); Naoto Kitahara, Saitama-ken (JP)

(73) Assignee: Mitsubishi Materials Corporation, Tokyo (JP)

( * ) Notice: Subject to any disclaimer, the term of this patent is extended or adjusted under 35 U.S.C. 154(b) by 0 days.

(21) Appl. No.: 09/618,062

(22) Filed: Jul. 17, 2000

(30) Foreign Application Priority Data

Jul. 16, 1999 (JP) ..... 11-202818

(51) Int. Cl.[7] ..... H01Q 1/38

(52) U.S. Cl. ..... 343/700 MS; 343/873; 29/600

(58) Field of Search ..... 343/700 MS, 702, 343/846, 873; 29/600; H01Q 1/38

(56) References Cited

U.S. PATENT DOCUMENTS 4,689,584 A * 8/1987 Sequeira ..... 343/700 MS
5,815,122 A 9/1998 Nurnberger et al. ..... 343/767
5,886,668 A * 3/1999 Pedersen et al. ..... 343/702
5,952,975 A * 9/1999 Pedersen et al. ..... 343/702
6,060,121 A * 5/2000 Hidber et al. ..... 427/261
6,281,842 B1 * 8/2001 Moren ..... 343/700 MS

FOREIGN PATENT DOCUMENTS

| | | |
|---|---|---|
| DE | 3732986 A1 | 4/1989 |
| EP | 0572701 A1 | 12/1993 |
| EP | 0790668 A2 | 8/1997 |
| JP | 10 125820 | 5/1998 |

* cited by examiner

*Primary Examiner*—Hoanganh Le
(74) *Attorney, Agent, or Firm*—Oblon, Spivak, McClelland, Maier & Neustadt, P.C.

(57) ABSTRACT

An antenna assembly having patterned conductive films on the surfaces of a dielectric hexahedron with compatibility to mass-production, wherein the conductive films are formed on protuberances formed on the surface of the dielectric hexahedron on which protuberances and depressions are formed. In one embodiment, the dielectric hexahedron includes convex portions serving as the protuberances and concave portions serving as the depressions. A conductive film may be formed on the protuberances by roll coating, sputtering, evaporative deposition, and electroless deposition, thereby producing inexpensively a high quality antenna assembly having a circuit pattern formed thereon.

20 Claims, 3 Drawing Sheets

METHOD FOR ANTENNA ASSEMBLY AND AN ANTENNA ASSEMBLY WITH A CONDUCTIVE FILM FORMED ON CONVEX PORTIONS

CROSS-REFERENCE TO RELATED APPLICATIONS

This application claims benefit of priority under 35 U.S.C. §119 to Japanese Patent Application No. 11-202818, filed on Jul. 16, 1999, the entire contents of which are incorporated by reference herein.

BACKGROUND OF THE INVENTION

1. Field of the Invention

The present invention relates to an antenna assembly comprising a hexahedron of a dielectric material on the surface of which a patterned conductive film is formed.

2. Description of the Related Art

While small size mobile communication sets such as a cordless telephone have been frequently used in recent years, antennas to be used in these communication sets are required to be compact, highly precise and cheap as other electronic components are.

The main body of this antenna is assembled so that a desired pattern of a conductive film is formed on each surface of a hexahedron of a dielectric material. The conductive film has been formed either by printing, plating, vapor deposition or sputtering.

In the printing method, however, a complicated and inefficient procedure was required since the pattern should be independently printed on each face of the hexahedron. It was also almost impossible to simultaneously print the patterns on plural faces of a polyhedron because simultaneous positioning of the patterns among printing blocks and plural faces of the polyhedron with a high precision was impossible.

The method for forming the conductive film either by plating, vapor deposition or sputtering comprises: a lift-off method in which the conductive film is formed after forming a resist film on the area where the conductive film is not formed on each face, followed by removing the resist film; and an etching method in which, after forming a conductive film on the entire surfaces on which the pattern is to be formed, a pattern of a resist film is formed on the foregoing film, followed by removing the conductive film in the area not covered with the resist film by etching.

However, since both methods described above require to form the resist film on each surface on which the pattern is to be formed, it was difficult to comply with the requirements of mass-production and low production cost.

SUMMARY OF THE INVENTION

Accordingly, the object of the present invention in view of the problems as set forth above is to provide a cheap antenna assembly suitable for mass-production, wherein a patterned conductive film is formed on the surface of a dielectric hexahedron.

In one aspect, the present invention for solving the foregoing problems provided an antenna assembly comprising a hexahedron of a dielectric material on each surface of which convex portions to serve as a circuit pattern are formed, wherein the circuit pattern comprising a conductive film is only formed on the convex portions.

In accordance with another aspect, the present invention provides a method for manufacturing an antenna assembly, wherein concave and convex portions are machined on the surface of a hexahedron of a dielectric material, and a desired pattern of a conductive film is formed on the convex portions using a roll coater.

The term "hexahedron" as used herein denotes not only a cube or a rectangular parallelpiped column, but also any type of hexahedrons so far as they have six faces. However, any of the two faces among the six faces are preferably in a parallel relation one another in view of the spirit of the present invention. Such hexahedrons having concave and convex portions formed on the surfaces of a hexahedron such as a cube or a rectangular parallelpiped column, or those having hollow spaces also belong to the hexahedron according to the present invention.

While the dielectric material constituting the hexahedron desirably comprises a ceramic, glass or a mixture of a ceramic and glass in view of mechanical strength, any dielectric materials may be used so long as it is not contrary to the spirit of the present invention. Accordingly, plastics are acceptable for that purpose.

Although a film comprising a pure metal or metal alloy may be advantageously used as the conductive film, use of other conductive materials such as a conductive resin is also possible.

It is desirable in the present invention that the edge angle between the surface of the hexahedron and the inner wall of the concave portion is 80 degree or more and 135 degree or less. The edge may be chipped on the edge when the angle is less than 80 degree while, when the angle is larger than 135 degree, inner faces of the concave portion may be contaminated during deposition of the conductive film to compromise the function of the antenna. A edge angle of more than 90 degree and less than 120 degree is desirable when the function of the antenna is emphasized.

The conductive film should be continuously formed through the mutually adjoining faces on the hexahedron in the present invention, and the edges are desirably chamfered, because the conductive film formed by coating a conductive paste may be possibly interrupted at the edge when the edges are not chamfered. The radius of chamfering is desirably 0.1 mm or more and 0.5 mm or less. The effect of chamfering will be invalid when the radius of chamfering is less than 0.1 mm, while the conductive paste can be hardly spread on the chamfered edge during coating to rather interrupt the conductive film when the radius of chamfering is larger than 0.5 mm.

DESCRIPTION OF THE PREFERRED EMBODIMENT

The embodiment of the present invention will be described hereinafter.

Figure 1:
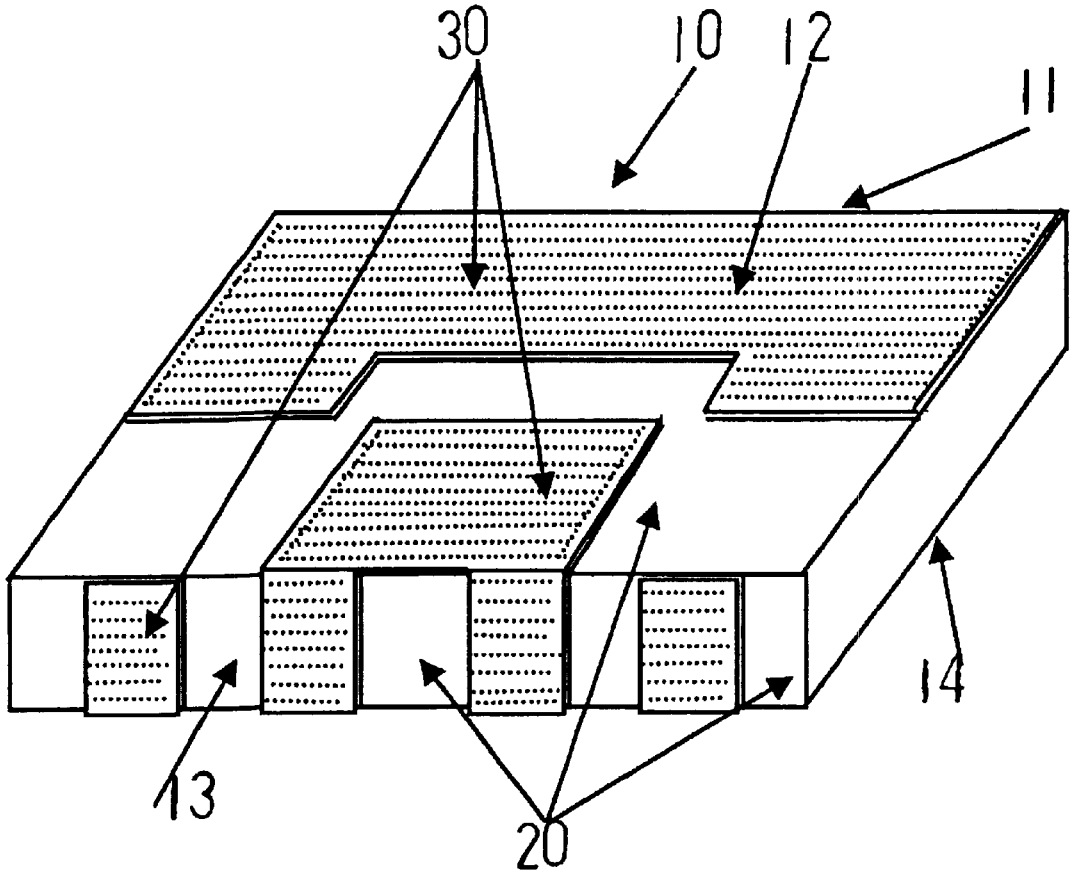
FIG. 1 shows a perspective view of one embodiment of the antenna assembly according to the present invention.

FIG. 1 shows a perspective view representing one embodiment of the antenna assembly according to the present invention. The pattern of the conductive film shown in FIG. 1 is merely one example among existing various patterns, and the present invention is never restricted to the pattern as set forth herein. The conductive film may be also formed on the remaining faces on which the conductive films have not been formed yet, or on the faces having no concave and convex portions, after forming the convex and concave portions.

The antenna assembly 10 is a hexahedron on the four surfaces 11, 12, 13, and 14 of which concave and convex portions are formed. Conductive films 30 (indicated by dotted lines) are formed on the convex portions on the four surfaces 11, 12, 13, and 14. The dielectric material in this embodiment comprises a mixture of aceramic and glass, and the conductive films 30 comprise an Ag/Pd film.

The surface 12 shown in FIG. 1 serves as an emission pattern face of the antenna, and the surface 13 serves as a power feed pattern face of the antenna. A Short-circuit pattern face and grounding face of the antenna are formed as well on the surfaces 11 and 14, respectively, although they are not illustrated.

Concave portions with a depth of 200 $\mu$m are formed on the area not indicated by the dotted lines in this perspective view. Since the Ag/Pd film is not deposited on the concave portions, a prescribed pattern that functions as an antenna is formed on the antenna assembly 10. No machining is applied on the remaining faces of the hexahedron in this embodiment.

Subsequently, the first embodiment of the antenna assembly 10 will be described hereinafter.

A mixture of an alumina powder, and two kinds of glass powders of $CaO—Al_2O_3—SiO_2$ based and $PbO—BaO—SiO_2$ based glasses are firstly prepared as a starting material of the dielectric material. The mixed powder is kneaded and granulated after adding water, an organic binder and a surface active agent. The granules are subjected to a press molding that also serves for forming concave and convex portions, thereby manufacturing hexahedrons, or rectangular parallelpiped columns, on the surfaces of which a pattern of the concave and convex portions are formed. After removing the binder from the hexahedron obtained, the hexahedron is fired to manufacture a hexahedron of a dielectric material.

Other method such as a cutting processing, laser processing and etching processing may be also employed for forming the concave portions 20 on the surface of the antenna assembly 10, other than the press molding method as described above.

Figure 2:
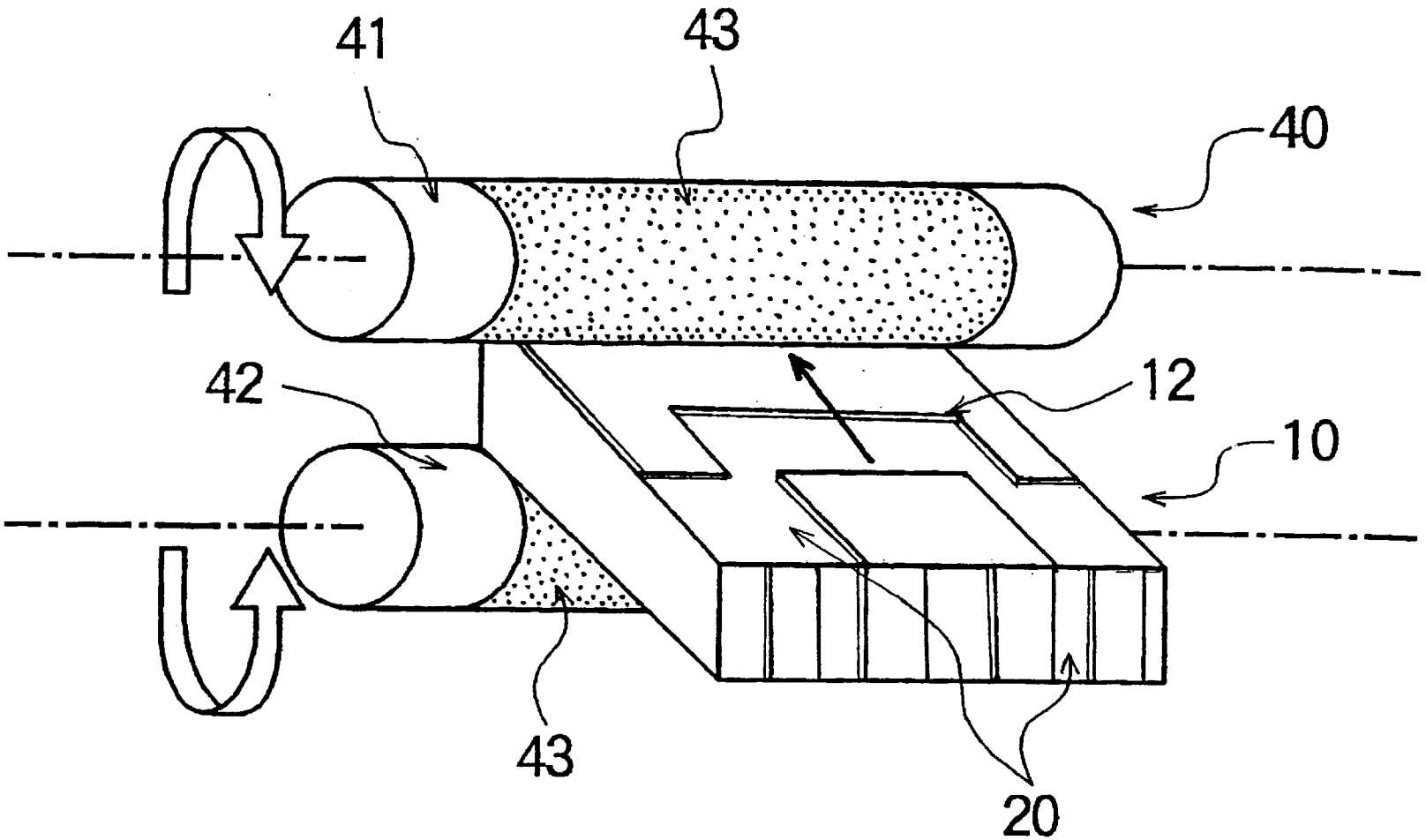
FIG. 2 shows one embodiment of the method for coating the conductive film on the antenna assembly according to the present invention using a roll coater.
Figure 3:
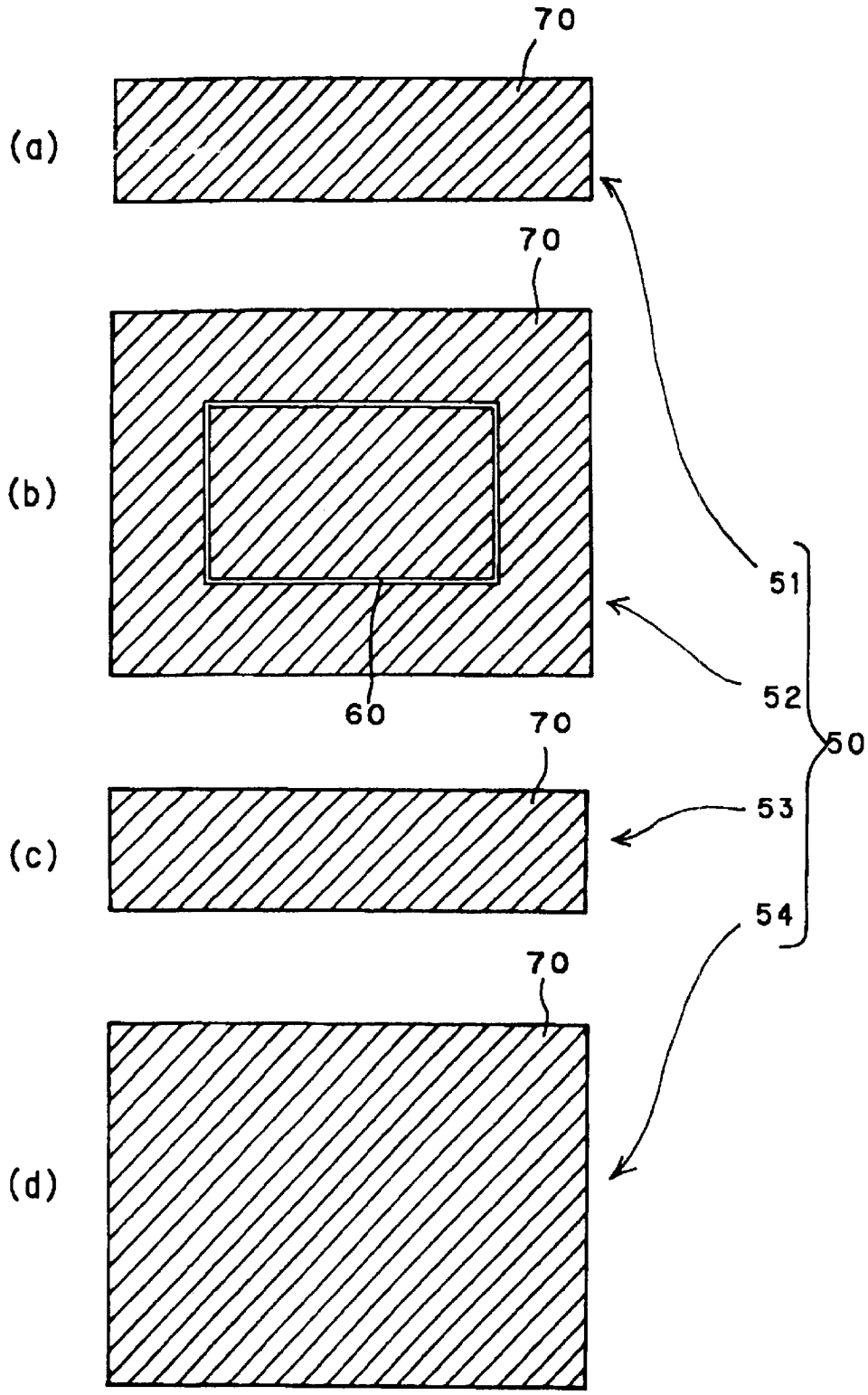
FIG. 3A shows one of the expanded drawings of the antenna assembly manufactured by the method according to the third embodiment.
FIG. 3B shows one of the expanded drawings of the antenna assembly manufactured by the method according to the third embodiment.
FIG. 3C shows one of the expanded drawings of the antenna assembly manufactured by the method according to the third embodiment.
FIG. 3D shows one of the expanded drawings of the antenna assembly manufactured by the method according to the third embodiment.

Then, conductive films are formed on the four faces 11, 12, 13, and 14 of the fired hexahedron using a roll coater shown in FIG. 2. As a result, the antenna assembly 10 on which conductive films 30 with a prescribed pattern are formed on the convex portions, or the portions excluding the concave portions 20, on the surfaces 11, 12, 13, and 14 of the hexahedron.

The method for forming the conductive film using the roll coater will be then described with reference to FIG. 2. FIG. 2 shows a schematic drawing of the method for forming the conductive film using the roll coater in FIG. 2.

The roll coater has a pair of rolls 41 and 42 rotating along the opposite directions with each other, and an Ag/Pd paste is coated on the rolls 41 and 42. When the conductive film is formed using this roll coater, an antenna assembly 10 on the surface of which convex portions and concave portions 20 are formed are inserted between two rollers so that the surfaces 12 and 14 make slight contact with either the roller 41 or the roller 42. Since the Ag/Pd paste only adheres on the convex portions after printing with the roll coater 40, the Ag/Pd films comprising a pattern of the emission face and a pattern of the grounding face of the antenna assembly are formed on the surface 12 and on the back face 14.

Subsequently, the antenna assembly 10 is inserted between the rollers of the roll coater 40 by allowing the insertion angle of the antenna assembly 10 relative to the roll coater 40 to rotate by an angle of 90 degree, to simultaneously print the short-circuit pattern face and the power feed pattern face of the antenna on the surfaces 11 and 13, respectively, thereby obtaining the antenna assembly on the four surfaces 11, 12, 13, and 14, of which the Ag/Pd films with desired patterns are formed.

A plurality of the antenna assemblies may be simultaneously manufactured in this embodiment by simultaneously inserting a plurality of antennae between the rollers of the roll coater.

Also, it is possible to simultaneously print the patterns on the four surfaces by using two couples of the pairs of the rollers by allowing one pair of the rollers to be disposed to be perpendicular to the other pair of the rollers.

The second embodiment of the antenna assembly according to the present invention will be described hereinafter.

An antenna assembly fired by the same method as described above is also prepared in the method for forming the conductive film in this embodiment. While the roll coater 40 having the same feature as described above (see FIG. 2) is also used in this embodiment, a solution of palladium chloride is coated on the roll coater in this method. The antenna assembly 10 coated with an aqueous solution of palladium chloride on its convex portions is dipped in a nickel electroless plating bath (not shown) in the next step to apply nickel plating on the portions where palladium chloride has been coated. In other words the conductive films are formed on the convex portions.

The third embodiment of the method for manufacturing the antenna assembly according to the present invention will be described hereinafter.

FIGS. 3A to 3D denote expanded drawings of the assembly manufactured in the third embodiment of the method for manufacturing the antenna assembly according to the present invention.

The expanded drawings of the assembly manufactured in the third embodiment of the method for manufacturing the assembly 50 according to the present invention are illustrated in FIGS. 3A to 3D.

The assembly 50 comprises a hexahedron of a ceramic, wherein concave portions 60 (the portions not indicated by the dotted lines) with a width of 200 $\mu$m and a depth of 400 $\mu$m are formed on the surface 52 among the four surfaces 51, 52, 53, and 54. An aluminum film 70 (the portions indicated by the dotted lines) that is a different material from the constituting material of the assembly 50 is formed on the portions of the surface 52 excluding the concave portion 60. The surface 52 shown in FIG. 3B corresponds to a top face of the assembly 50, while the surface 54 shown in FIG. 3D denotes a bottom face. A plurality of these assemblies were arranged along the horizontal direction with the surface 52 as the top face upward, and the Al film was formed by sputtering on the five surfaces of each antenna assembly except the surface 54 as a bottom face. Although the Al film was adhered on a part of the inner wall face of the concave portion, no film adhered on the wall face at a depth of 200 μm or more, indicating that patterned films can be formed on the surface of the polyhedron by the method for manufacturing the assembly according to the present invention. Such assembly as described above can be machined to utilize it as an antenna assembly.

The same result as described in the third embodiment can be also obtained when the Al film is deposited by using a vapor deposition method, instead of the sputtering method used in the third embodiment.

The conductive films are formed only on the convex portions of the hexahedron of the dielectric material on the surface of which the concave and convex portions are formed in the antenna assembly according to the present invention. Consequently, the conductive films that are essential for the antenna assembly can be precisely and easily deposited to enable the good quality antenna assembly to be cheaply manufactured in large scale.

What is claimed is:

1. A method for manufacturing an antenna assembly, comprising:

machining concave portions and convex portions on the surface of a hexahedron of a dielectric material; and forming a desired pattern of a conductive film over an entirety of the convex portions using a roll coater, without forming the conductive film on the concave portions.

2. An antenna assembly, comprising:

a dielectric material having a plurality of surfaces, at least one surface thereof serving as an emission pattern face, at least one surface thereof including a protruding portion in the dielectric material that substantially defines a circuit pattern and a non-protruding portion, and at least one surface serving as a power feed pattern face, and at least one surface serving as a grounding pattern face; and a conductive film substantially formed over an entirety of said protruding portion and at least one other surface of said plurality of surfaces, without forming the conductive film on the non-protruding portions.

3. The assembly of claim 2, further comprising:

an adhesion layer substantially formed between said protruding portion and said conductive film.

4. The assembly of claim 3, wherein said adhesion layer comprises palladium chloride.

5. The assembly of claim 2, wherein said conductive film comprises an electroless film.

6. The assembly of claim 5, wherein said electroless film comprises a nickel electroless film.

7. The assembly of claim 2, wherein said at least one surface further comprises a recessed portion.

8. The assembly of claim 7, wherein said recessed portion comprises a depression extending from a plane including said at least one surface into said dielectric material.

9. The assembly of claim 2, wherein said protruding portion comprises a protuberance projection above a plane including said at least one surface.

10. A method for manufacturing an antenna assembly, comprising steps of:

forming on at least one surface of a dielectric material a protruding portion in the dielectric material substantially defining a circuit pattern and a non-protruding portion; and coating an entirety of said protruding portion and at least one further surface with a conductive film, without coating the conductive film on the non-protruding portion.

11. The method according to claim 10, wherein said forming said protruding portion comprises a step of press molding said dielectric material in a mold.

12. The method according to claim 10, wherein said step of forming said protruding portion comprises etching a recessed portion of said dielectric material.

13. The method according to claim 10, wherein said coating said protruding portion comprises a step of roll coating said conductive film.

14. The method according to claim 10, wherein said coating step comprises sputtering said conductive film, and said step of forming a protruding portion comprises forming a recessed portion deeper than a thickness of said conductive film.

15. The method according to claim 10, wherein said coating step comprises vapor depositing said conductive film, and said step of forming a protruding portion comprises forming a recessed portion deeper than said conductive film is thick.

16. The method according to claim 10, wherein said coating step comprises:

forming an adhesion layer on said protruding portion; and electrodepositing said conductive film on said adhesion layer.

17. The method according to claim 16, wherein said step of forming an adhesion layer comprises a step of roll printing said adhesion layer.

18. The method according to claim 10, further comprising a step of chamfering an edge where said at least one surface and a second surface of said dielectric material meet.

19. The method according to claim 16, wherein said adhesion layer comprises palladium chloride.

20. An antenna assembly comprising a hexahedron having a surface on which convex portions to serve as a circuit pattern and concave portions are formed, and having at least one surface thereof serving as an emission pattern face; and a conductive film formed over an entirety of the convex portions without being formed on the concave portions.

* * * * *